US009243831B2

(12) United States Patent
Hattori et al.

(10) Patent No.: US 9,243,831 B2
(45) Date of Patent: Jan. 26, 2016

(54) HEAT EXCHANGING SYSTEM

(75) Inventors: Syuji Hattori, Kobe (JP); Tatsuhiro Tokuyama, Kobe (JP)

(73) Assignee: EN-TECH CO., LTD., Kobe-Shi, Hyogo (JP)

( * ) Notice: Subject to any disclaimer, the term of this patent is extended or adjusted under 35 U.S.C. 154(b) by 345 days.

(21) Appl. No.: 13/822,602

(22) PCT Filed: Oct. 17, 2011

(86) PCT No.: PCT/JP2011/005800
§ 371 (c)(1),
(2), (4) Date: Mar. 12, 2013

(87) PCT Pub. No.: WO2012/053184
PCT Pub. Date: Apr. 26, 2012

(65) Prior Publication Data

US 2013/0174593 A1 Jul. 11, 2013

(30) Foreign Application Priority Data

Oct. 18, 2010 (JP) ..... 2010-233289
Mar. 16, 2011 (JP) ..... 2011-057912

(51) Int. Cl.

| | |
|---|---|
| ***F25B 49/02*** | (2006.01) |
| ***F25B 6/04*** | (2006.01) |
| ***F28D 5/00*** | (2006.01) |
| ***F28D 7/00*** | (2006.01) |
| ***F28D 7/10*** | (2006.01) |
| *F25B 13/00* | (2006.01) |

(52) U.S. Cl.
CPC . *F25B 49/02* (2013.01); *F25B 6/04* (2013.01); *F28D 5/00* (2013.01); *F28D 7/0016* (2013.01); *F28D 7/106* (2013.01); *F25B 13/00* (2013.01); *F25B 2313/021* (2013.01); *F25B 2339/047* (2013.01); *F25B 2400/06* (2013.01); *F25B 2700/21161* (2013.01)

(58) Field of Classification Search
CPC ..... F25B 6/04; F25B 13/00; F25B 49/02; F25B 2313/021; F25B 2339/047; F25B 2400/06; F25B 2700/21161; F25D 7/00; F25D 7/106; F25D 5/00
See application file for complete search history.

(56) References Cited

U.S. PATENT DOCUMENTS

| | | | | |
|---|---|---|---|---|
| 3,989,183 | A * | 11/1976 | Gustafsson | 237/2 B |
| 6,089,039 | A | 7/2000 | Yamauchi | |
| 7,886,549 | B2 * | 2/2011 | Kawakatsu et al. | 62/183 |
| 2008/0302113 | A1 * | 12/2008 | Yin et al. | 62/115 |
| 2010/0064723 | A1 | 3/2010 | Kawakatsu | |

FOREIGN PATENT DOCUMENTS

| | | |
|---|---|---|
| JP | S47-14285 | 5/1972 |
| JP | S61-141667 | 9/1986 |

(Continued)

*Primary Examiner* — Marc Norman

(57) ABSTRACT

In an air conditioning system, a compressor, a condenser, and an indoor unit that functions as an evaporator during cooling, are provided in a circulation pathway of a refrigerant, in respective order during cooling. An additional heat exchanger is provided in the circulation pathway at a point that during cooling is between the condenser and the indoor unit. The additional heat exchanger is contained within a tank of a cooling device. The cooling device performs cooling of the additional heat exchanger by supplying water into the tank. Quantity of water supplied into the tank is controlled through open/close control of a control valve.

9 Claims, 10 Drawing Sheets

(56) References Cited

FOREIGN PATENT DOCUMENTS

| | | |
|---|---|---|
| JP | H1-158062 | 10/1989 |
| JP | 05-071809 | 3/1993 |
| JP | 11-051523 | 2/1999 |
| JP | 2000-79519 | 4/2000 |
| JP | 2007-071504 | 3/2007 |

* cited by examiner

HEAT EXCHANGING SYSTEM

TECHNICAL FIELD

The present invention relates to heat exchanging systems, and in particular to heat exchanging systems that have configurations aimed at reducing environmental burden.

BACKGROUND ART

At present air conditioning systems, which are one type of heat exchanging system, are widely used for conditioning of air in homes, offices and shops. An air conditioning system has a configuration where a refrigerant repeatedly absorbs and radiates heat while circulating between an indoor unit and an outdoor unit.

It is no longer possible to use refrigerants that cause destruction of the ozone layer, such as R12 ($CF_2Cl_2$) and R502 (HCFC22/CFC115), therefore alternative refrigerants that have low ozone depletion potential such as HCFCs and HFCs must be used instead. Unfortunately, when one of the alternative refrigerants is used in an air conditioning system, there is a lower heat exchange efficiency than compared to when a conventional refrigerant such as R12 or R502 is used.

One art proposed for counteracting the negative effect of the lower heat exchange efficiency that occurs when one of the alternative refrigerants is used, is to enhance condensation of the refrigerant (for example refer to Patent Literature Configuration of an air conditioning system that uses the above art is explained below with reference to FIG. 10.

As shown in FIG. 10, the air conditioning system relating to the conventional art comprises an indoor unit 91 and an outdoor unit 92 that are connected to one another by refrigerant piping $L_{91}$ and $L_{97}$. The indoor unit 91 is provided with a heat exchanger that functions as an evaporator during cooling, and an expansion valve. The outdoor unit 92 is provided with a compressor 921, a condenser 922, and a flow pathway switching part 923. The compressor 921 and the flow pathway switching part 923 are connected by refrigerant piping $L_{92}$, and the condenser 922 and the flow pathway switching part 923 are connected by refrigerant piping $L_{93}$ and $L_{94}$.

In the air conditioning system relating to the conventional art shown in FIG. 10, the outdoor unit 92 is further provided with an additional heat exchanger 93. The additional heat exchanger 93 is connected to the flow pathway switching part 923 in the outdoor unit 92 by refrigerant piping $L_{95}$ and $L_{96}$.

FIG. 10 shows an example of a circulation pathway (cycle) of a refrigerant during cooling.

In the air conditioning system relating to the conventional art shown in FIG. 10, through the configuration where the additional heat exchanger 93 is provided in addition to the condenser 922, decompression and condensation can be achieved in two steps, and a reduction in volume of the refrigerant can be achieved by conversion to liquid phase. In the above air conditioning system, by reducing the volume of the refrigerant, load on the condenser 921 can also be reduced, giving improved heat exchange efficiency.

CITATION LIST

Patent Literature

[Patent Literature 1]

Japanese Patent Publication No. 3218289

SUMMARY OF INVENTION

Technical Problem

There is demand for even greater levels of energy efficiency from heat exchanging systems such as the air conditioning system shown in FIG. 10. Also, due to variations in outdoor temperature, even addition of the additional heat exchanger 93 in the air conditioning system relating to the conventional art may not efficiently enhance condensation. In recent years, improving heat exchange efficiency is becoming increasingly difficult, in particular due to rising outdoor temperatures caused for example by heat island effects.

The present invention has been achieved in view of the above problems, and an aim thereof is to provide a heat exchanging system that is able to achieve improved heat exchange efficiency in a wide range of environmental conditions. Specifically, the present invention aims to improve heat exchange efficiency of existing air-cooling type heat exchanging systems cheaply and simply.

Solution to Problem

In order to solve the above problems, the present invention is configured as described below.

A heat exchanging system relating to the present invention comprises: a compressor; a first heat exchanger that functions as a condenser during cooling; a second heat exchanger that functions as an evaporator during cooling; and a temperature adjustment device that performs temperature adjustment of a heat carrier using a liquid, wherein the compressor, the first heat exchanger and the second heat exchanger are provided in a circulation pathway of the heat carrier, in respective order during cooling, and the temperature adjustment device is provided on (i) the first heat exchanger, or (ii) a section of the circulation pathway that during cooling is downstream of the first heat exchanger and upstream of the second heat exchanger.

Also, the heat exchanging system relating to the present invention comprises: a plurality of compressors; a plurality of first heat exchangers that each function as a condenser during cooling; a plurality of second heat exchangers that each function as an evaporator during cooling; a plurality of third heat exchangers; and a temperature adjustment device that performs temperature adjustment of a heat carrier using a liquid and that is provided with a tank for storing the liquid, wherein one of the compressors, one of the first heat exchangers and one of the second heat exchangers are provided in each of a plurality of independent circulation pathways of the heat carrier, in respective order during cooling, one of the third heat exchangers is provided in each of the plurality of independent circulation pathways at a point that during cooling is downstream of the first heat exchanger and upstream of the second heat exchanger, and the plurality of third heat exchangers are each contained within the tank provided in the temperature adjustment device.

Advantageous Effects of Invention

In the heat exchanging system relating to the present invention, the temperature adjustment device, that performs temperature adjustment of the heat carrier using the liquid, is provided on (i) the first heat exchanger, or (ii) the section of the circulation pathway that during cooling is downstream of the first heat exchanger and upstream of the second heat exchanger. Therefore, for the second heat exchanger, compared to the heat exchanging (air conditioning) system relating to the conventional art where heat exchange is with air, compression and condensation of the heat carrier (refrigerant) can be performed with little effect from environmental conditions, and thus electricity consumption can be reduced. The above is due to the temperature adjustment device performing temperature adjustment using the liquid, and thus compression and condensation of the heat carrier not being easily influenced by environmental conditions.

Furthermore, the heat exchanging system relating to the present invention can be achieved simply by adding the temperature adjustment device to an existing heat exchanging system. Therefore equipment costs are reduced by continued use of the existing heat exchanging system. Due to the configuration relating to the present invention being achieved simply by adding the temperature adjustment device to the existing heat exchanging system, and also due to maintenance of the temperature adjustment device being simple, the heat exchanging system relating to the present invention may be used widely while also providing reduced equipment costs.

The heat exchanging system relating to the present invention can perform heat exchange efficiently in a wide range of environmental conditions, therefore an advantageous effect of the present invention is high heat exchange efficiency. Specifically, the heat exchanging system relating to the present invention may be applicable for air conditioning systems, refrigeration systems, freezing systems and the like.

The configuration of the heat exchanging system relating to the present invention may be modified in various ways as explained below.

The heat exchanging system relating to the present invention may further comprise a third heat exchanger, provided in the circulation pathway at a point that during cooling is downstream of the first heat exchanger and upstream of the second heat exchanger, wherein the temperature adjustment device is provided with a tank for storing the liquid, and the third heat exchanger is contained within the tank.

Through the above configuration including the third heat exchanger, decompression and condensation can be performed in two stages by the first heat exchanger and the third heat exchanger, thus electricity consumption can be reduced. The third heat exchanger is contained within the tank of the temperature adjustment device, and temperature adjustment can be performed using the liquid in the temperature adjustment device. Therefore, compression and condensation of the heat carrier can be achieved reliably with little effect from environmental conditions, and electricity consumption can be further reduced. Furthermore, the third heat exchanger is provided in addition to the first heat exchanger and may be smaller in size than the first heat exchanger, therefore electricity consumption can be reduced without needing to significantly increase size of the system.

The heat exchanging system relating to the present invention may further comprise: a first temperature sensor configured to measure temperature of the heat carrier at an output side, during cooling, of the third heat exchanger; a second temperature sensor configured to measure temperature in the tank; a third temperature sensor configured to measure peripheral temperature of the first heat exchanger; a fourth temperature sensor configured to measure temperature of the liquid supplied into the tank of the temperature adjustment device; and a control device configured to control a temperature adjustment condition of the temperature adjustment device, based on temperature information indicating the respective temperatures measured by the first, second, third and fourth temperature sensors. In the above configuration, the control device causes the temperature adjustment device to operate at an optimal temperature adjustment condition, thus decompression and condensation can be performed reliably, and electricity consumption can be further reduced.

In the heat exchanging system relating to the present invention, the tank of the temperature adjustment device may be connected to an injection pathway for supplying the liquid thereto, and a discharge pathway for discharging the liquid therefrom, the injection pathway and the discharge pathway may each be provided with a control valve for controlling flow volume of the liquid therethrough, and the control device may control the temperature adjustment condition of the temperature adjustment device, based on the temperature information of the first, second, third and fourth temperature sensors, through open/close control of each of the two control valves. In the above configuration, temperature adjustment can be reliably controlled based on the measured temperatures, by controlling supply flow volume and discharge flow volume of the liquid.

More specifically, if the respective temperatures measured by the first, second, third and fourth temperature sensors are $T_1$, $T_2$, $T_3$ and $T_4$, when judging that conditions shown below in MATH 1-3 are all satisfied, the control device may open the control valve provided in the injection pathway and may close the control valve provided in the discharge pathway.

$$T_1>T_4 \quad \text{[MATH 1]}$$

$$T_3>T_4 \quad \text{[MATH 2]}$$

$$T_4\leq T_2<T_3 \quad \text{[MATH 3]}$$

Alternatively, in the heat exchanging system relating to the present invention, the tank in the temperature adjustment device may be connected to an injection pathway for supplying the liquid therein, and a discharge pathway for discharging the liquid therefrom, at least one spray outlet, that sprays the liquid against the third heat exchanger, may be provided on a section of the injection pathway extending into the tank, the injection pathway may be provided with a control valve for controlling flow volume of the liquid therethrough, and the control device may control the temperature adjustment condition of the temperature adjustment device through open/close control of the control valve. In the above configuration, in addition to the effects described above, volume of the liquid used can be reduced, and a high degree of control of temperature adjustment can be achieved through heat of vaporization effects. More specifically, the heat exchanging system relating to the present invention may have a configuration wherein, the respective temperatures measured by the first, second, third and fourth temperature sensors are $T_1$, $T_2$, $T_3$ and $T_4$, and when judging that conditions shown below in MATH 4-6 are all satisfied, the control device may open the control valve provided in the injection pathway.

$$T_1>T_4 \quad \text{[MATH 4]}$$

$$T_3>T_4 \quad \text{[MATH 5]}$$

$$T_4\leq T_2<T_3 \quad \text{[MATH 6]}$$

Alternatively, in the heat exchanging system relating to the present invention, the temperature adjustment device may include a coil-type heat exchanger or a Liebig type heat exchanger, provided on piping that during cooling is between the third heat exchanger and the second heat exchanger in the circulation pathway. In the above configuration, decompression and condensation can be performed reliably and electricity consumption can be reduced in the same way as described above.

Alternatively, the heat exchanging system relating to the present invention may further comprise: a first pressure sensor provided in the circulation pathway at a point between the third heat exchanger and the second heat exchanger, and configured to measure pressure of the heat carrier thereat; a second pressure sensor provided in the circulation pathway at a point between the second heat exchanger and the compressor, and configured to measure pressure of the heat carrier thereat; and a control device configured to control a temperature adjustment condition of the temperature adjustment device, based on pressure information indicating the respective pressures measured by the first and second pressure sensors. In the heat exchanging system relating to the present invention, control of temperature adjustment may be performed by controlling flow of the liquid based on the pressure information of the heat carrier such as in the configuration above. If the configuration above is adopted, decompression and condensation can be performed more reliably, and electricity consumption can be reduced in the same way as described above. In the above configuration only two pressure sensors are necessary, thus costs can be further reduced.

Furthermore, if the heat exchanging system relating to the present invention includes a plurality of circulation pathways, each of the third heat exchangers may be contained within a single tank. Therefore, in addition to the effects described above, equipment cost and system size can both be reduced.

DESCRIPTION OF EMBODIMENTS

Embodiments of the present invention are described below with reference to the drawings. The embodiments below are given in order to facilitate easily understandable explanation of configuration features and effects of the present invention. The present invention is not limited by contents of the embodiments below, except in regards to essential technical features of the present invention.

First Embodiment

1. System Outline

Below an outline explanation of a heat exchanging system relating to a first embodiment is given with reference to FIG. 1. In the first embodiment an air conditioning system 1 is adopted as an example of the heat exchanging system.

Figure 1:
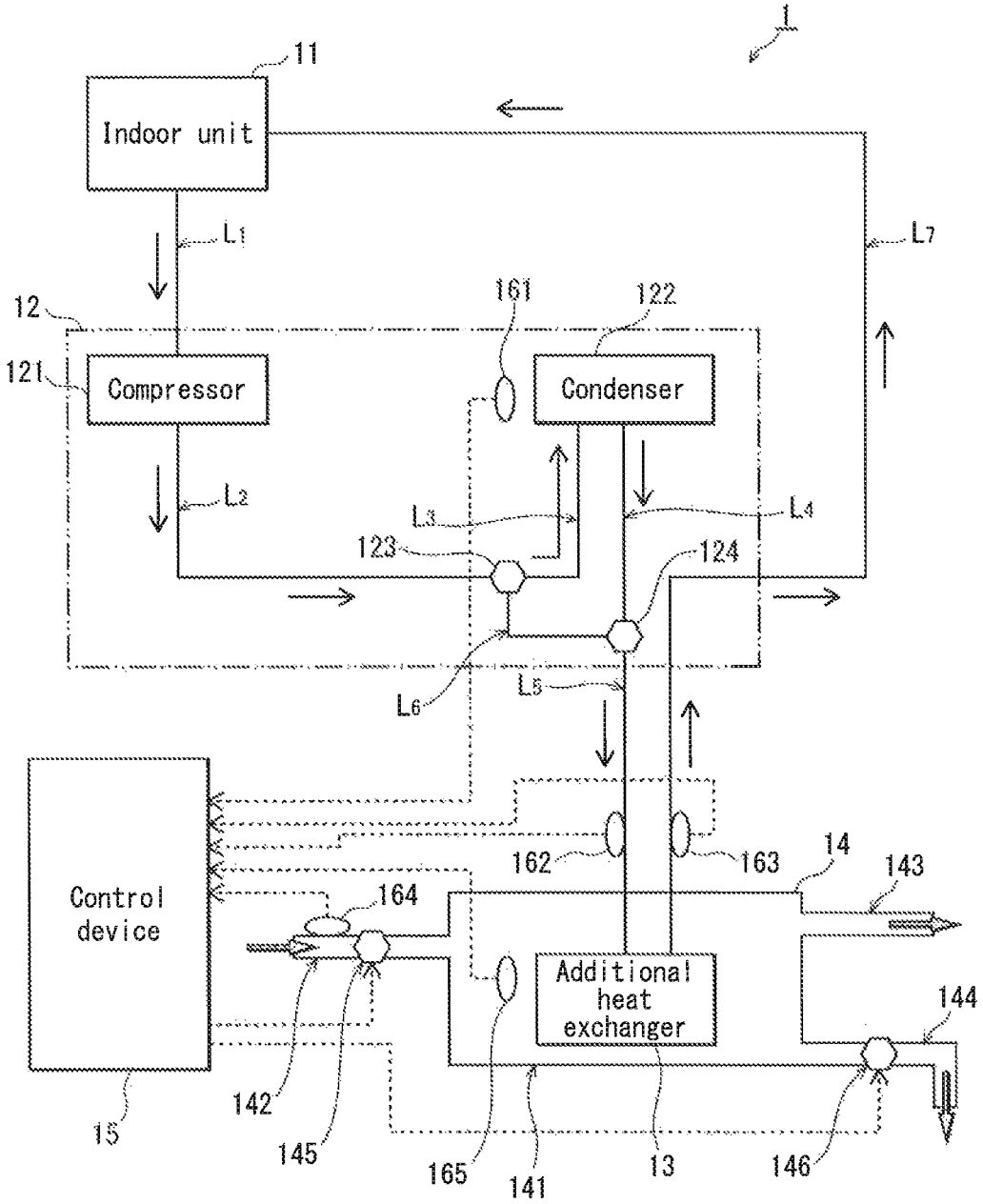
FIG. 1 is a schematic block diagram showing configuration of an air conditioning system 1 relating to a first embodiment of the present invention.

As shown in FIG. 1, the air conditioning system 1 includes an indoor unit 11, an outdoor unit 12, an additional heat exchanger 13, a cooling device 14, and a control device 15. The outdoor unit 12 is connected to the indoor unit 11 through refrigerant piping $L_1$, and includes a compressor 121, a condenser 122, and flow pathway switching valves 123 and 124.

The indoor unit 11 includes a heat exchanger that functions as an evaporator during cooling, and an expansion valve such as a capillary tube (omitted in the drawings). It is not essential that the expansion valve be a configuration element of the indoor unit 11, and alternatively the expansion valve may for example be inserted through refrigerant piping $L_7$.

In the outdoor unit 12, the compressor 121 and the flow pathway switching valve 123 are connected through refrigerant piping $L_2$, and the flow switching valve 123 and the condenser 122 are connected through refrigerant piping $L_3$. The condenser 122 of the outdoor unit 12 is connected to the additional heat exchanger 13 through refrigerant piping $L_4$, the flow pathway switching valve 124, and refrigerant piping $L_5$. The additional heat exchanger 13 and the indoor unit 11 are connected through the refrigerant piping $L_7$.

The flow pathway switching valves 123 and 124 are connected through refrigerant piping $L_6$. FIG. 1 shows connections during cooling, when the refrigerant piping $L_2$ is connected to the refrigerant piping $L_3$ through the flow pathway switching valve 123, and the refrigerant piping $L_4$ is connected to the refrigerant piping $L_5$ through the flow pathway switching valve 124. Consequently, refrigerant does not flow through the refrigerant piping $L_6$ during cooling.

As shown in FIG. 1, the additional heat exchanger 13 is provided in the circulation pathway of the refrigerant at a position that during cooling is between the condenser 122 of the outdoor unit 12, and the indoor unit 11. The additional heat exchanger 13 is contained within a cooling tank 141 in the cooling device 14.

In addition to the cooling tank 141, the cooling device 14 also includes a water injection pathway 142, a water outlet 143, a water discharge pathway 144, and control valves 145 and 146 which are positioned on the water injection pathway 142 and the water discharge pathway 144 respectively. The control valves 145 and 146 each open and close based on a control signal from the control device 15.

The control device 15 is connected to a plurality of temperature sensors 161-165 through signal wires, thus allowing temperature information indicating temperatures measured by the temperature sensors 161-165 to be input into the control device 15. The temperature sensor 161 is provided adjacent to the condenser 122 of the outdoor unit 12 so as to measure peripheral temperature of the condenser 122. The temperature sensor 162 is provided on the refrigerant piping $L_5$ so as to measure temperature of the refrigerant flowing through the refrigerant piping $L_5$. Similarly, the temperature sensor 163 is provided on the refrigerant piping $L_7$ so as to measure temperature of the refrigerant flowing through the refrigerant piping $L_7$. The above configuration means that during cooling the temperature sensor 162 measures temperature of the refrigerant at an inlet to the additional heat exchanger 13 and the temperature sensor 163 measures temperature of the refrigerant at an outlet from the additional heat exchanger 13.

As shown in FIG. 1, in the present embodiment the temperature sensor 161 is provided adjacent to the condenser 122 of the outdoor unit 12, but the temperature sensor 161 is not limited to being positioned as described above. Alternatively, the temperature sensor 161 may be provided separated from the condenser 122 and may measure outdoor temperature.

The temperature sensor 164 is provided on the water injection pathway 142 of the cooling device 14 so as to measure temperature of water flowing through the water injection pathway 142. Temperature sensor 165 is provided in the cooling tank 141 of the cooling device 14 so as to measure temperature inside the cooling tank 141.

A flare nut, which is omitted in the drawings, is provided on a part of each of the refrigerant piping $L_5$ and the refrigerant piping $L_7$ that inserts into the cooling tank 141. The above configuration allows easy repair and replacement of the additional heat exchanger 13.

The air conditioning system 1 has a configuration where the indoor unit 11, the outdoor unit 12 and the additional heat exchanger 13 are provided in the circulation pathway of the refrigerant, and the cooling device 14, controlled by the control device 15, is provided as an attachment onto the additional heat exchanger 13.

In the air conditioning system 1 relating to the present embodiment, decompression and condensation are performed in two steps through the condenser 122 of the outdoor unit 12 and the additional heat exchanger 13. Therefore, electricity consumption can be reduced. Furthermore, by providing the additional heat exchanger 13 at a position in the circulation pathway of the refrigerant that is downstream of the condenser 1 during cooling, the refrigerant can be compressed more reliably than if the additional heat exchanger 13 is provided at a position upstream of the condenser 122. Also, through the above configuration, refrigerant in the condenser 122 is mostly in liquid phase, reducing load on the compressor 121. The refrigerant in the condenser 122 being in liquid phase allows reduction in load due to environmental conditions and realization of high heat exchange efficiency.

In the air conditioning system 1, the additional heat exchanger 13 is contained within the cooling tank 141 of the cooling device 14, and temperature adjustment (cooling) can be performed using the water in the cooling device 14. Compared to the air conditioning system relating to the conventional art, where heat exchange by the additional heat exchanger is only with air, the above configuration allows more reliable compression and condensation of the refrigerant, and reduced electricity consumption. By using a liquid (water) for temperature adjustment which has relatively small variation in temperature compared to outdoor temperature, compression and condensation of the refrigerant can be performed with little effect from environmental conditions, compared to when heat exchange is with air.

The air conditioning system 1 relating to the present embodiment is configured so that, when water supplied into the cooling tank 141 is at least equal to a predetermined level, water is discharged from cooling tank 141 through the water outlet 143. The above configuration allows the air conditioning system 1 to maintain higher cooling efficiency in the cooling tank 141 than if only water stored in the cooling tank 141 is used for cooling. The above also allows capacity of the cooling tank 141 to be reduced.

The air conditioning system 1 relating to the present embodiment can be realized using an existing air conditioning system, simply by addition of the cooling device 14 and positioning of the additional heat exchanger 13 within the cooling tank 141 of the cooling device 14. Therefore, equipment costs can be reduced by making use of the existing air conditioning system.

2. Control by the Control Device 15

Open/close control of control valves 145 and 146 performed by the control device 15, is explained below with reference to FIG. 2. Control performed by the control device 15 is explained below using on/off control as an example.

Figure 2:
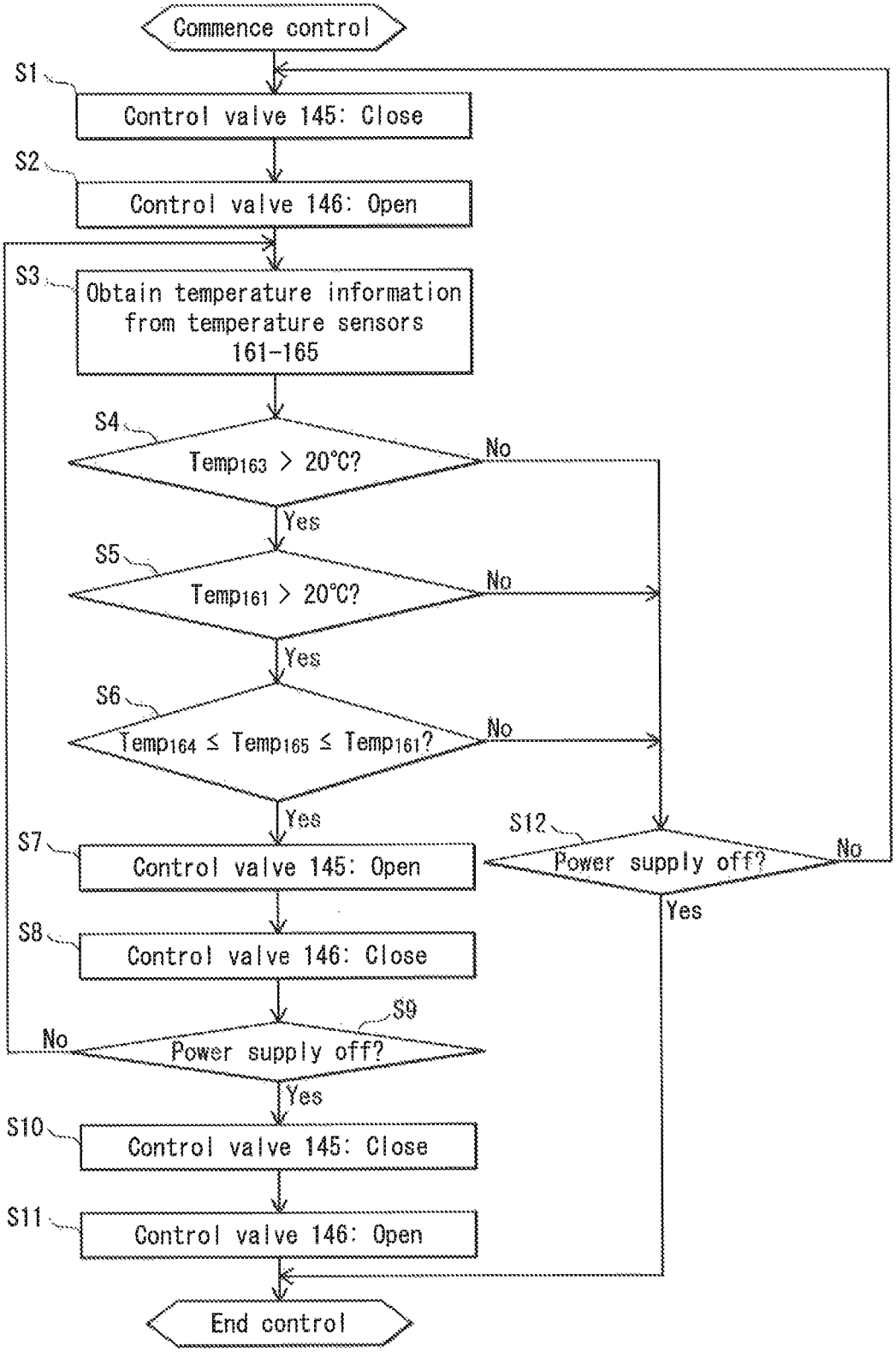
FIG. 2 is a flow chart showing control performed by a control device 15 in the air conditioning system 1 during cooling.

As shown in FIG. 2, when the air conditioning system 1 commences operation, the control device 15 sets the control valve 145 to "Closed" (Step S1) and the control valve 146 to "Open" (Step S2). Therefore, when the air conditioning system 1 initially commences operation, water does not flow into the cooling tank 141. The control device 15 obtains temperature information, indicating measured temperatures, from each of the temperature sensors 161-165 (Step S3), and judges whether conditions shown below in MATH 7-9 are satisfied (Steps S4-S6).

$$Temp_{163} > 20° C. \quad \text{[MATH 7]}$$

$$Temp_{161} > 20° C. \quad \text{[MATH 8]}$$

$$Temp_{164} \leq Temp_{165} < Temp_{161} \quad \text{[MATH 9]}$$

The conditions shown above are for a situation where the outdoor temperature is 35° C. and water supplied into the cooling tank 141 is of a constant temperature.

The control device 15, when judging that all of the conditions in MATH 7-9 are satisfied, sets the control valve 145 to "Open" (Step S7) and sets the control valve 146 to "Closed" (Step S8). The above causes water to flow into the cooling tank 141, thus cooling the additional heat exchanger 13. After checking that power supply is not turned off (Step S9: No), the control device 15 repeats judgments in Steps S3-S6.

The control device 15, when judging that at least one of the conditions in MATH 7-9 is not satisfied (Step S4, S5 or S6: No), checks that the power supply is not turned off (Step S12: No), and subsequently repeats the above control from Step S1.

If the power supply is turned off (Step S9 or S12: Yes), the control device 15 sets the control valve 145 to "Closed" (Step S10) and sets the control valve 146 to "Open", thus completing the control by the control device 15. Therefore, when the air conditioning system 1 is not operating, flow of water into the cooling tank 141 is stopped and the water discharge pathway 144 is open.

Figure 10:
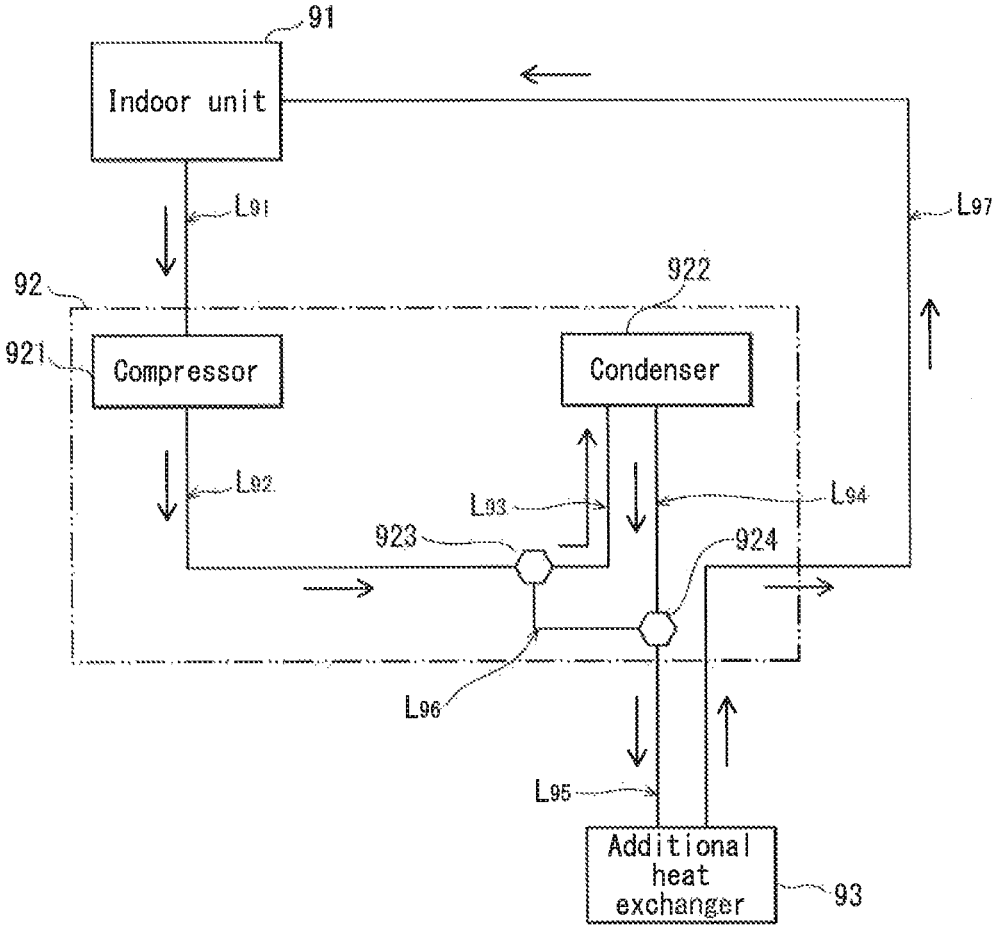
FIG. 10 Prior Art
FIG. 10 is a schematic block diagram showing configuration of an air conditioning system relating to a conventional art.

In the air conditioning system 1 relating to the present embodiment, when cooling of the additional heat exchanger 13 is performed by the control described above, peripheral temperature of the additional heat exchanger 13 can be reduced by approximately 15 deg, compared to the air conditioning system relating to the conventional art shown in FIG. 10. Furthermore, a temperature difference between intake air and discharge air of the indoor unit 11 can be increased by approximately 2 deg. to 3 deg. compared to the air conditioning system relating to the conventional art. Consequently, in the air conditioning system 1 relating to the present embodiment electricity consumption can be reduced by approximately 20% to 30% compared to the air conditioning system relating to the conventional art.

The present embodiment was described using on/off control as an example of control performed by the control device 15. Alternatively, based on the obtained temperature information the control device 15 may perform proportional control for opening and closing each of the control valves 145 and 146. In the above configuration, control can be performed more precisely and consequently electricity consumption can be further reduced.

3. Air Conditioning System 1 During Heating

In the air conditioning system 1 relating to the present embodiment, a control such as described above can be performed even during heating. Configuration of the air conditioning system 1 during heating is explained below with reference to FIG. 3.

Figure 3:
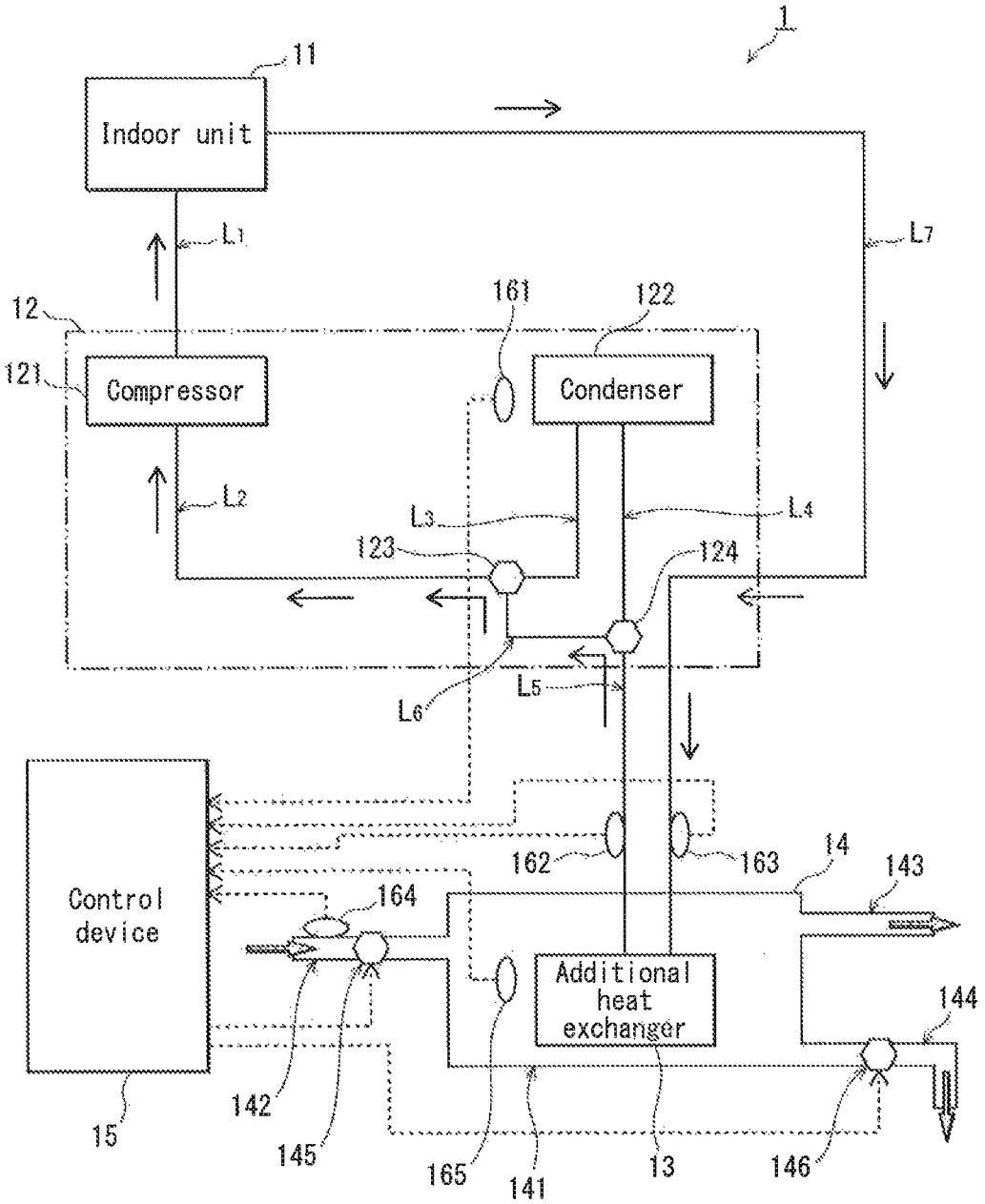
FIG. 3 is a schematic block diagram showing configuration of the air conditioning system 1 during heating.

As shown in FIG. 3, during heating the flow pathway switching valves 123 and 124 switch flow so that the refrigerant piping $L_2$ is connected to the refrigerant piping $L_5$. In other words, refrigerant output from the compressor 121 flows to the additional heat exchanger 13 via the indoor unit 11, and refrigerant output from the additional heat exchanger 13 returns to the compressor 121 via the refrigerant piping $L_5$ and the refrigerant piping $L_2$ without passing through the condenser 122 of the outdoor unit 12.

Even when the flow pathway switching valves 123 and 124 switch flow of the refrigerant in order to perform heating, load on the compressor and electricity consumption can be reduced through open/close control of the control valves 145 and 146 by the control device 15, based on the temperature information from the temperature sensors 161-165.

Furthermore, when the air conditioning system 1 relating to the present embodiment is used in a factory or the like, waste water or waste steam from the factory may be supplied into the cooling tank 141 of the cooling device 14, allowing performance of defrosting during heating. Through the configuration described above, the air conditioning system 1 can commence heating even when there is icing of the air conditioning system 1.

4. Variations in Control of Air Conditioning System 1 During Heating

Control of the air conditioning system 1 during heating is described above with reference to FIG. 3. Different variations in control of the air conditioning system 1 during heating are described below.

(i) The configuration shown in FIG. 1 for during cooling may also be used during heating by controlling circulation of the refrigerant in a reverse direction. In the above configuration, refrigerant output from the indoor unit 11 flows to the additional heat exchanger 13 via the refrigerant piping $L_7$, and refrigerant output from the additional heat exchanger 13 flows to the condenser 122 via the refrigerant piping $L_5$. Refrigerant output from the condenser 122 flows to the compressor 121 via the refrigerant piping $L_2$, and refrigerant output from the compressor 121 flows to the indoor unit 11 via the refrigerant piping $L_1$, thus completing a single circulation.

Assume for example that refrigerant circulation is reversed as described above, and during heating when the outdoor temperature is no greater than 5° C., temperature of the refrigerant flowing through the refrigerant piping $L_7$ is close to 0° C. If ground water is supplied into the cooling tank 141 without any alteration of temperature, temperature of water in the cooling tank 141 is approximately 15° C.

In the above situation, refrigerant flowing into the additional heat exchanger 13 via the refrigerant piping $L_7$ is heated in the additional heat exchanger 13 to approximately 10° C. Therefore, even if due to the outdoor temperature of no greater than 5° C. the refrigerant decreases in temperature in the condenser 122, the refrigerant flows to the compressor 121 at a temperature of approximately 6° C. to 8° C.

Even if heat exchange in the condenser 122 is 100% efficient, temperature of the refrigerant flowing to the compressor 121 is similar to the outdoor temperature at approximately 5° C.

(ii) Alternatively, control during heating may be performed as described below.

In contrast to the configuration shown in FIG. 1 for during cooling, heating may be realized by providing a pathway between the refrigerant piping $L_5$ and the refrigerant piping $L_7$ that bypasses the additional heat exchanger 13, and by reversing flow direction of the refrigerant compared to the arrows in FIG. 1.

For example, if the refrigerant flows from the refrigerant piping $L_7$ to the refrigerant piping $L_5$ without passing through the additional heat exchanger 13, temperature of the refrigerant flowing into the condenser 122 is approximately 0° C. The outdoor temperature is approximately 5° C., therefore the refrigerant absorbs heat from the atmosphere, and the refrigerant flowing to the compressor 121 after passing through the condenser 122 has a temperature of approximately 2° C. to 3° C.

Even if heat exchange in the condenser 122 is 100% efficient, temperature of the refrigerant flowing to the compressor 121 is similar to the outdoor temperature at approximately 5° C.

Comparison of configurations (i) and (ii) shows that temperature of the refrigerant flowing to the compressor 121 is higher for the configuration (i). In other words, the configuration (i) aids the compressor 121 in increasing temperature of the refrigerant during heating. Therefore, by adopting the configuration which makes use of the additional heat exchanger 13 and the cooling device 14, electricity consumption during heating can be reduced.

Second Embodiment

Figure 4:
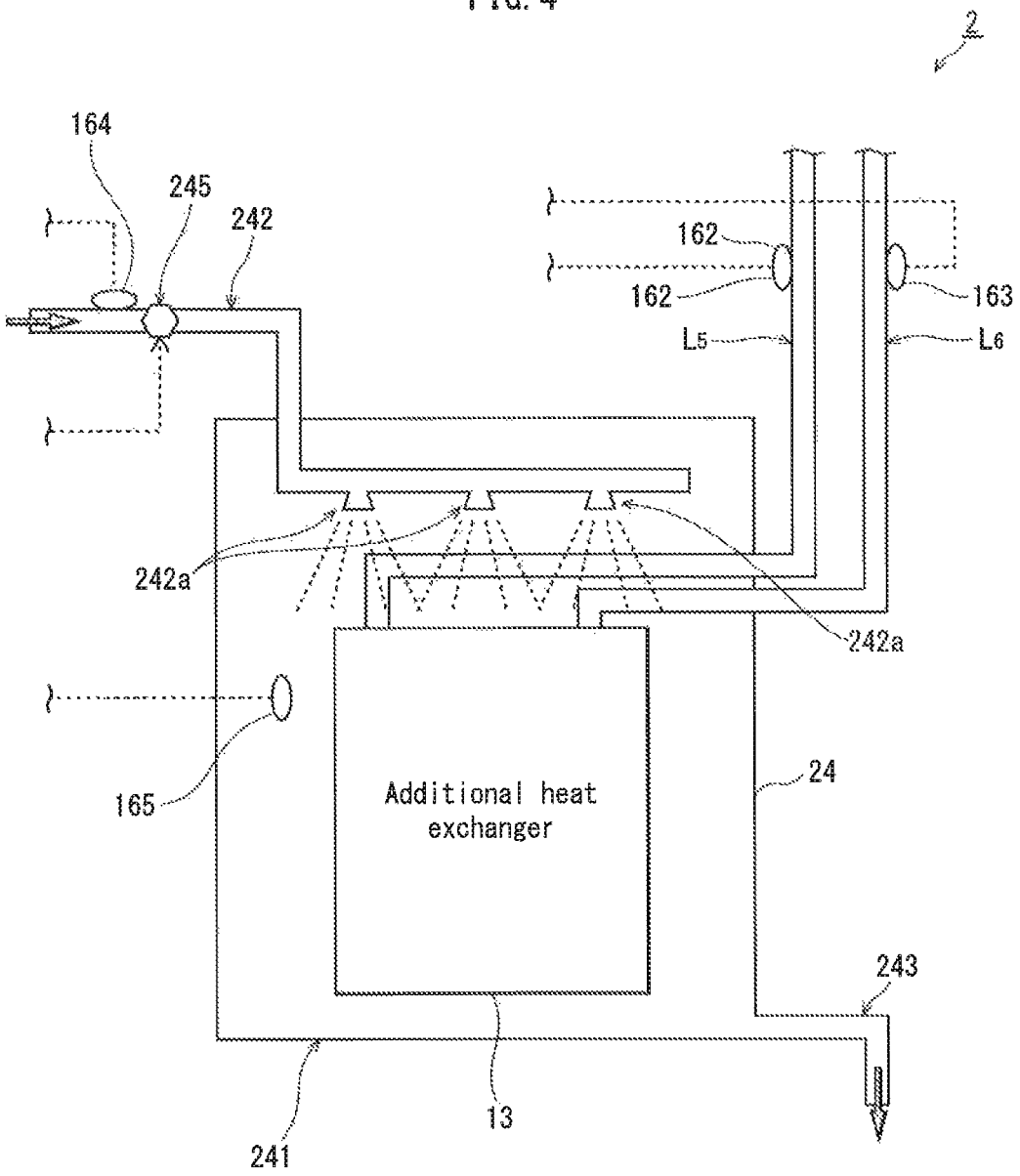
FIG. 4 is a schematic diagram showing a part which is a feature of an air conditioning system 2 relating to a second embodiment of the present invention.

Configuration of an air conditioning system 2 relating to a second embodiment is explained below with reference to FIG. 4. FIG. 4 shows differences between the air conditioning system 2 and the air conditioning system 1, and parts having identical configurations are omitted.

As shown in FIG. 4, in the air conditioning system 2 relating to the present embodiment, a plurality of water spray outlets 242*a* are provided on an end section of a water injection pathway 242 in a cooling tank 241 of a cooling device 24. In other words, the end section is a section of the water injection pathway 242 that is contained within the cooling tank 241. In the air conditioning system 2 relating to the present embodiment, the water injection pathway 242 and a water outlet 243 are included relative to the cooling tank 241, but no water discharge pathway is included. Therefore, the control device 15 only performs open/close control of a control valve 245 provided on the water injection pathway 242.

In the air conditioning system 2 relating to the present embodiment, the control device 15, when judging that all of the conditions in MATH 7-9 are satisfied, sets the control valve 245 to "Open". When at least one of the conditions in MATH 7-9 is not satisfied, the control device 15 sets the control valve 245 to "Closed".

Other than differences listed above, configuration of the air conditioning system 2 is identical to the air conditioning system 1 relating to the first embodiment, therefore explanation is omitted here.

In the air conditioning system 2 relating to the present embodiment, cooling of the additional heat exchanger 13 is achieved by spraying water supplied through the water injection pathway 242 against the additional heat exchanger 13 in a shower or mist form. Compared to the cooling device 14 in the first embodiment, the above configuration achieves a similar level of cooling using a smaller volume of water. Therefore, the air conditioning system 2 can achieve the same effects as described for the air conditioning system 1 relating to the first embodiment.

The water spray outlets 242*a* may be set small enough to create a thy-mist, in which case cooling of the additional heat exchanger 13 is performed through heat of vaporization effects. The above configuration has an advantage of reducing rusting of the additional heat exchanger 13.

The present embodiment was explained for an example where cooling of the additional heat exchanger 13 is performed by spraying water, supplied through the water injection pathway 242, against the additional heat exchanger 13 in the shower or mist form. If the water is sprayed as a mist, various different particle sizes may be adopted for water in the mist. By spraying water in the mist form it is also possible to take advantage of heat of vaporization of the water in order to achieve high heat exchange efficiency.

When water in the mist has a small particle size, vaporization occurs soon after spraying of the water, therefore rusting of the additional heat exchanger 13 is reduced. The term "mist" used above refers to where particle diameter is on the scale of micrometers or tens of micrometers, and concentration is on the scale of several particles or tens of particles per cubic centimeter.

Third Embodiment

Configuration of an air conditioning system 3 relating to a third embodiment is explained below with reference to FIG. 5.

Figure 5:
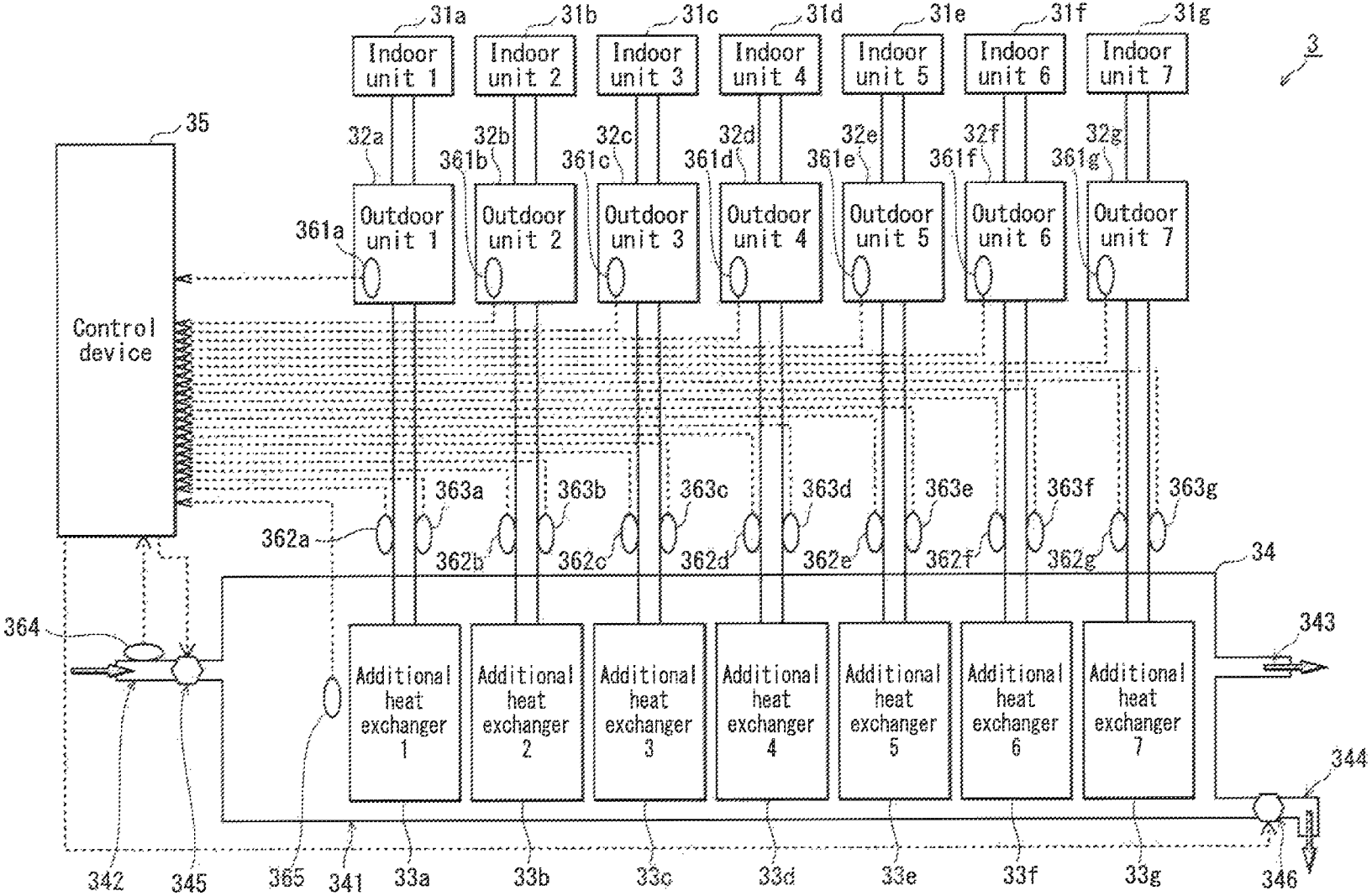
FIG. 5 is a schematic block diagram showing configuration of an air conditioning system 3 relating to a third embodiment of the present invention.

As shown in FIG. 5, in the air conditioning system 3 relating to the third embodiment there are seven circulation pathways of the refrigerant that are independent of one another.

Internal configurations of outdoor units 32*a*-32*g* are not shown in FIG. 5, but each of the outdoor units 32*a*-32*g* has an identical internal configuration to the outdoor unit 12 in the air conditioning system 1 relating to the first embodiment.

In the air conditioning system 3 relating to the present embodiment, the outdoor units 32*a*-32*g* are respectively connected to additional heat exchangers 33*a*-33*g*. All seven of the additional heat exchanger 33*a*-33*g* are contained within a single cooling tank 341.

The cooling tank 341 is included in a cooling device 34, which also includes a water injection pathway 342, a water outlet 343, and a water discharge pathway 344, each connecting to the cooling tank 341 in the same way as in the cooling device 14 in the air conditioning system 1. Control valves 345 and 346 are respectively provided on the water injection pathway 342 and the water discharge pathway 344 for controlling flow volume of water. A control device 35 performs open/close control of each of the control valves 345 and 346.

Temperature sensors 361*a*-361*g* are respectively provided in the outdoor units 32*a*-32*g*. Temperature sensors 362*a*-362*g* and temperature sensors 363*a*-363*g* are respectively provided on refrigerant piping connecting outdoor units 32*a*-32*g* and additional heat exchangers 33*a*-33*g*. Temperature sensors 364 and 365 are respectively provided on the water injection pathway 342 and in the cooling tank 341.

In the configuration of the air conditioning system 3 shown in FIG. 5, temperature information indicating temperatures measured by each of the temperature sensors 361*a*-361*g*, 362*a*-362*g*, 363*a*-363*g*, 364 and 365 is input into the control device 35. Based on the temperature information the control device 35 performs open/close control of the control valve 345.

The control device 35 may perform open/close control of the control valve 345 based on whether conditions in MATH 7-9 are all satisfied for at least one of the seven circulation pathways, or alternatively based on whether conditions in MATH 7-9 are all satisfied for all seven of the circulation pathways. Further alternatively, control of the control valve 345 may be based on averages of the seven circulation pathways, in other words based on averages of measured temperatures obtained from the temperature sensors 361*a*-361*g*, 362*a*-362*g*, and 363*a*-363*g*.

For the air conditioning system 3 where there are a plurality of circulation pathways of the refrigerant, positioning all of the additional heat exchangers 33*a*-33*g* in the cooling tank 341, has an advantage of reducing equipment costs. The air conditioning system 3 relating to the present embodiment is able to achieve the same effects as described for the air conditioning system 1 relating to the first embodiment.

Alternatively, the cooling tank 341 may be partitioned into a plurality of sections each containing one of the additional heat exchangers 33*a*-33*g*, and each of the sections may have a water injection pathway and a water discharge pathway each provided with a control valve.

Fourth Embodiment

Figure 6:
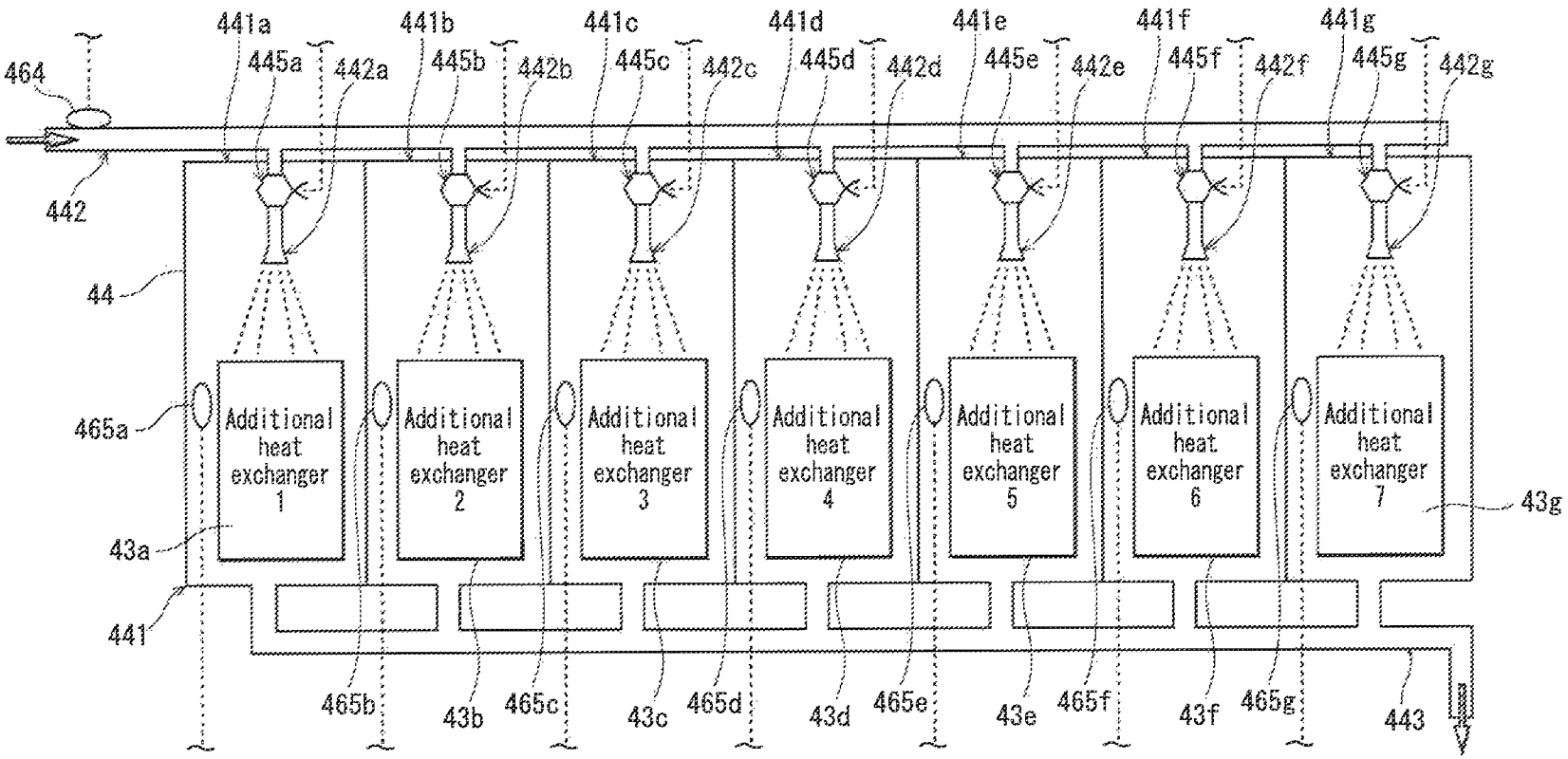
FIG. 6 is a schematic block diagram showing configuration of an air conditioning system 4 relating to a fourth embodiment of the present invention.

Configuration of an air conditioning system 4 relating to a fourth embodiment is explained below with reference to FIG. 6. FIG. 6 shows parts of the configuration of the air conditioning system 4 that differ from the configuration of the air conditioning system 3; identical parts are omitted.

As shown in FIG. 6, in the air conditioning system 4 a cooling tank 441 of a cooling device 44 is partitioned into a plurality of cooling chambers 441*a*-441*g* respectively containing the additional heat exchangers 43*a*-43*g*. Water spray inlets 442*a*-442*g* are provided on sections of a water injection pathway 442 corresponding to the cooling chambers 441*a*-441*g* respectively. Each of the cooling chambers 441*a*-441*g* is connected to a water discharge pathway 443.

A temperature sensor 464 is provided on the water injection pathway 442 for measuring temperature of water supplied into the cooling tank 441. Control valves 445*a*-445*g* are respectively provided on the water spray outlets 442*a*-442*g*. Through the above configuration, supply of water can be controlled individually with respect to each of the additional heat exchangers 43*a*-43*g*.

Temperatures sensors 465*a*-465*g* are respectively provided in the cooling chambers 441*a*-441*g* of the cooling tank 441, so as to measure temperature in the cooling chambers 441*a*-441*g* respectively. Through the above configuration it is possible to measure peripheral temperature of each of the additional heat exchangers 43*a*-43*g*.

In the air conditioning system 4 relating to the present embodiment, the cooling tank 441 is partitioned into the plurality of cooling chambers 441*a*-441*g* respectively containing the addition heat exchangers 43*a*-43*g*. The water spray outlets 442*a*-442*g* are provided on sections of the water injection pathway 442 corresponding respectively to the cooling chambers 441*a*-441*g*. Spraying of water from the water spray outlets 442*a*-442*g* is controlled respectively by open/close control of the control valves 445*a*-445*g*. Through the configuration described above, the air conditioning system 4 is able to perform control more precisely than the air conditioning system 3 relating to the third embodiment. Therefore, the air conditioning system 4 achieves further reduction in electricity consumption.

Possible variations regarding water spraying described for the air conditioning system 2 relating to the second embodiment may be applied in the same way in the present embodiment.

In the present embodiment, during cooling if the additional heat exchangers 43*a*-43*g* water sprayed from the water spray outlets 442*a*-442*g* may be in mist form. When sprayed in mist form various different particle sizes of the water are possible. Different particle sizes and effects thereof are explained above for the air conditioning system 2. When the water is sprayed in mist form, high heat exchange efficiency can be achieved due to heat of vaporization of the water.

First Modified Example

A cooling device relating to a first modified example is explained below with reference to FIG. 7A.

Figure 7A:
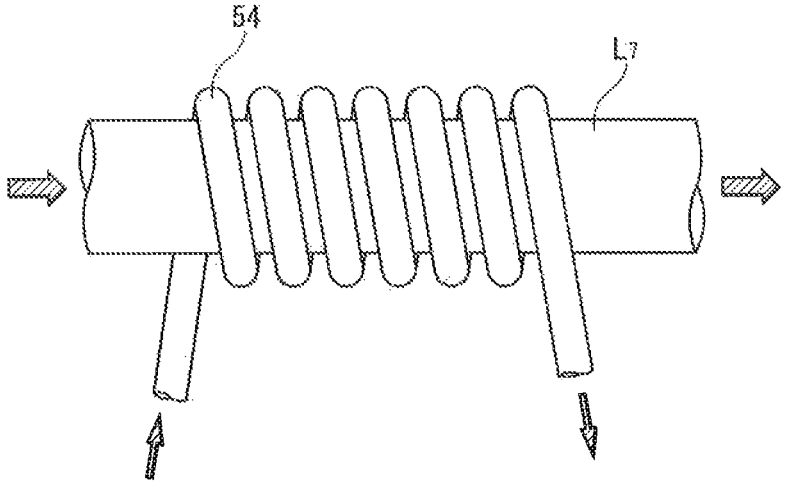
FIG. 7A is a schematic perspective view showing configuration of part of a cooling device relating to a first modified example.

As shown in FIG. 7A, in the cooling device relating to the first modified example, a cooling coil 54 of a coil type heat exchanger is provided around the refrigerant piping $L_7$, which connects the additional heat exchanger 13 and the indoor unit 11 in the circulation pathway of the refrigerant. Water flows through the cooling coil 54. By providing the cooling coil 54 around the refrigerant piping $L_7$ and performing cooling of the refrigerant in the refrigerant piping $L_7$, electricity consumption can be reduced in the same way as described in the first to fourth embodiments. In all other aspects configuration may be the same as any of the air conditioning systems 1-4 relating to the first to fourth embodiments respectively.

The first modified example was described for a configuration where the cooling coil 54 of the coil type heat exchanger is provided around the refrigerant piping $L_7$ that connects the additional heat exchanger 13 and the indoor unit 11. However, the above is not a limitation on the present invention, and alternatively the cooling coil 54 may be provided around refrigerant piping at an output side of the outdoor unit 12, or around refrigerant piping within the outdoor unit 12.

Further alternatively, in the present invention two or more cooling coils may be provided. If there are a plurality of cooling coils in the heat exchanging system, the cooling coils may be provided around refrigerant piping at various points in the circulation pathway of the refrigerant, such as described above. Through the above configuration where cooling coils such as shown in FIG. 7A are provided around refrigerant piping in the circulation pathway of the refrigerant, high heat exchange efficiency can be achieved even for example when capability of an existing condenser in an outdoor unit is not accurately known, when an existing condenser in not functionally efficiently or when an existing condenser is completely omitted.

Second Modified Example

A cooling device relating to a second modified example is explained below with reference to FIG. 7B.

Figure 7B:
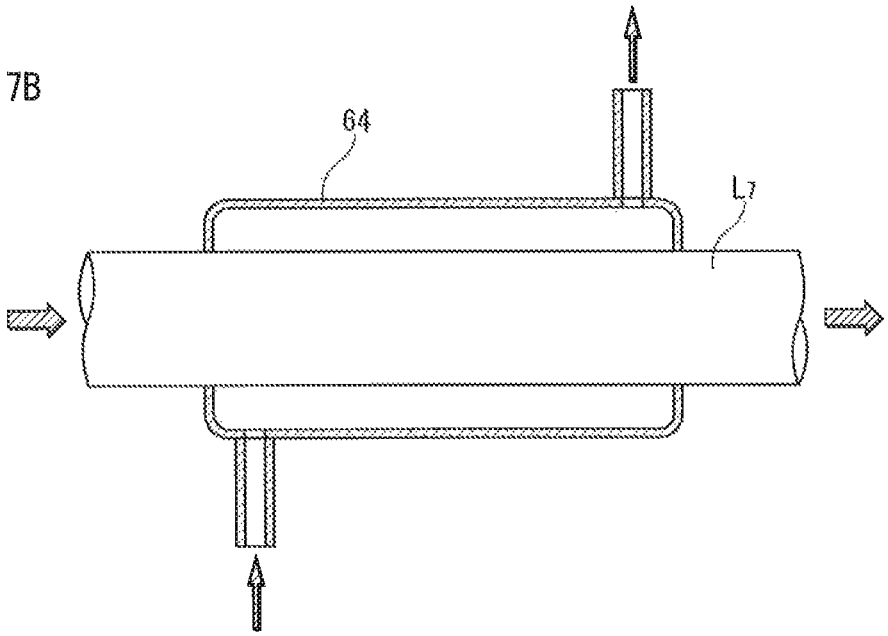
FIG. 7B is a schematic cross-sectional view showing configuration of part of a cooling device relating to a second modified example.

As shown in FIG. 7B, the cooling device relating to the second modified example is a Liebig-type heat exchanger, where an outer cooling pipe 64 is provided around the refrigerant piping $L_7$. In the cooling device relating to the present modified example, water flows through the outer cooling pipe 64 cooling the refrigerant, and thus electricity consumption can be further reduced.

In the present modified example the outer cooling pipe 64 of the Liebig-type heat exchanger is provided around the refrigerant piping $L_7$. However, the above is not a limitation on the present invention, and alternatively the outer cooling pipe 64 may be provided around refrigerant piping at the output side of the outdoor unit 12, or around refrigerant piping within the outdoor unit 12.

Further alternatively, in the present invention two or more outer cooling pipes may be provided. If there are a plurality of outer cooling pipes in the heat exchanging system, the outer cooling pipes may be provided around refrigerant piping at various points in the circulation pathway of the refrigerant, such as described above. Through the above configuration where outer cooling pipes such as shown in FIG. 7B are provided around refrigerant piping in the circulation pathway of the refrigerant, high heat exchange efficiency can be achieved even for example when capability of an existing condenser in an outdoor unit is not accurately known, when an existing condenser in not functionally efficiently or when an existing condenser is completely omitted.

Fifth Embodiment

1. System Outline

A heat exchanging system relating to a fifth embodiment is outlined below with reference to FIG. 8. In the present embodiment, the air conditioning system 7 is given as one example of the heat exchanging system.

Configuration of the air conditioning system 7 relating to the fifth embodiment is similar to configuration of the air conditioning system 1 relating to the first embodiment. Therefore, reference signs for identical configuration elements are the same as for the air conditioning system 1, and detailed explanation is omitted.

Figure 8:
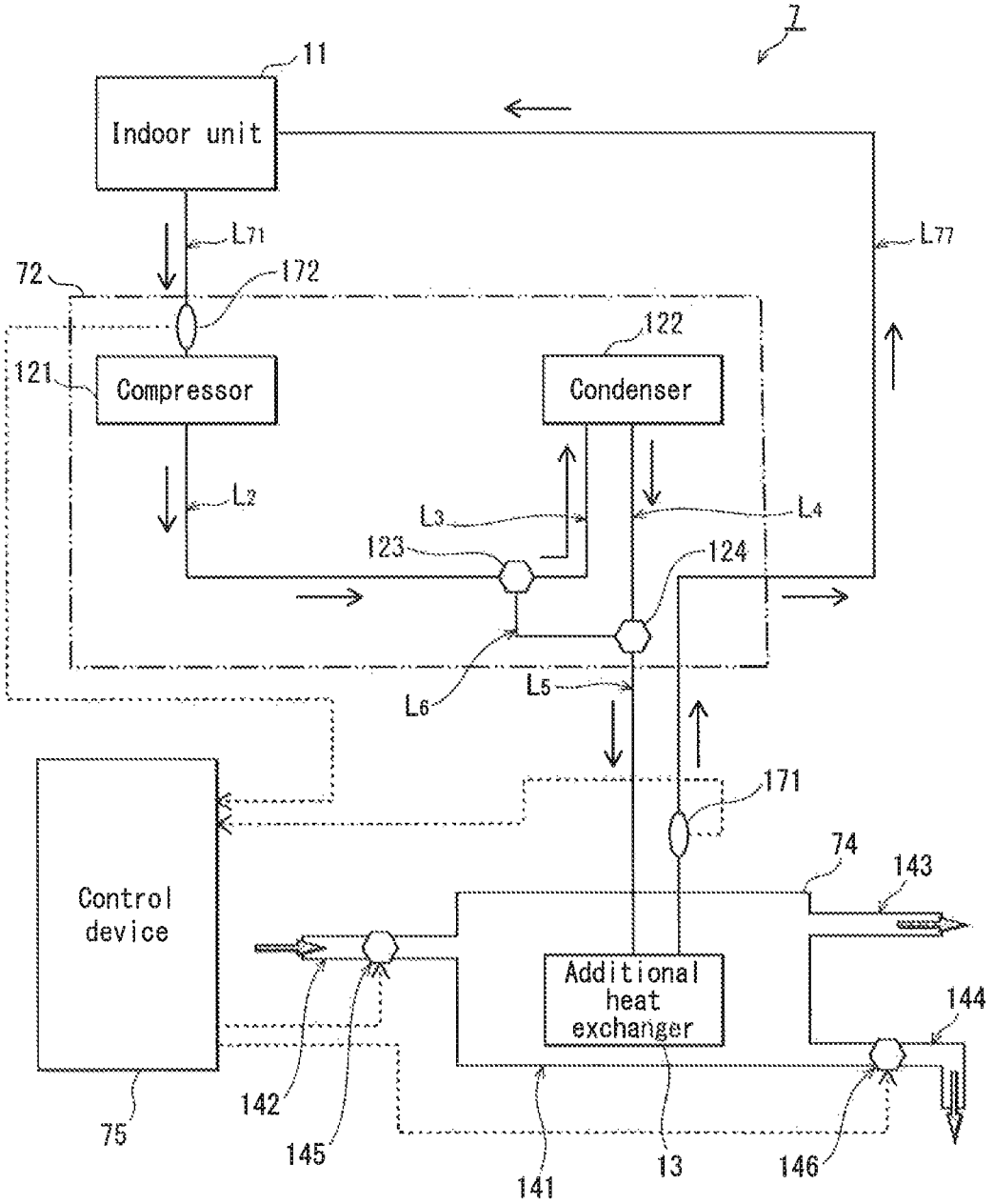
FIG. 8 is a schematic block diagram showing configuration of an air conditioning system 7 relating to a fifth embodiment of the present invention.

As shown in FIG. 8, in the air conditioning system 7 a pressure sensor 171 is provided in refrigerant piping $L_{77}$ that connects the additional heat exchanger 13 and the indoor unit 11. More specifically, the pressure sensor 171 is provided in the refrigerant piping $L_{77}$ at a position adjacent to an output point from the additional heat exchanger 13. A pressure sensor 172 is provided in refrigerant piping $L_{71}$ that connects the indoor unit 11 and the compressor 121 of an outdoor unit 72. More specifically, the pressure sensor 172 is provided in the refrigerant piping $L_{71}$ at a position adjacent to an input point into the compressor 121.

The pressure sensors 171 and 172 are each connected to a control device 75, and each send pressure information to the control device 75 indicating pressure of the refrigerant measured at respective positions thereof.

In the present embodiment, temperature sensors are not provided on the outdoor unit 72, the refrigerant piping $L_5$, the refrigerant piping $L_{77}$, and cooling unit 74.

In the air conditioning system 7 relating to the fifth embodiment, open/close control of each of the control valves 145 and 146 in the cooling device 74, is performed based on the pressure information obtained from the pressure sensors 171 and 172.

2. Control by the Control Device 75

Open/close control of the control valves 145 and 146 performed by the control device 75 is explained below with reference to FIG. 9. As in the first embodiment, on/off control is given as an example for explaining the control performed by the control device 75 in the present embodiment. Conditions below are given as an example for when the refrigerant is R22.

Figure 9:
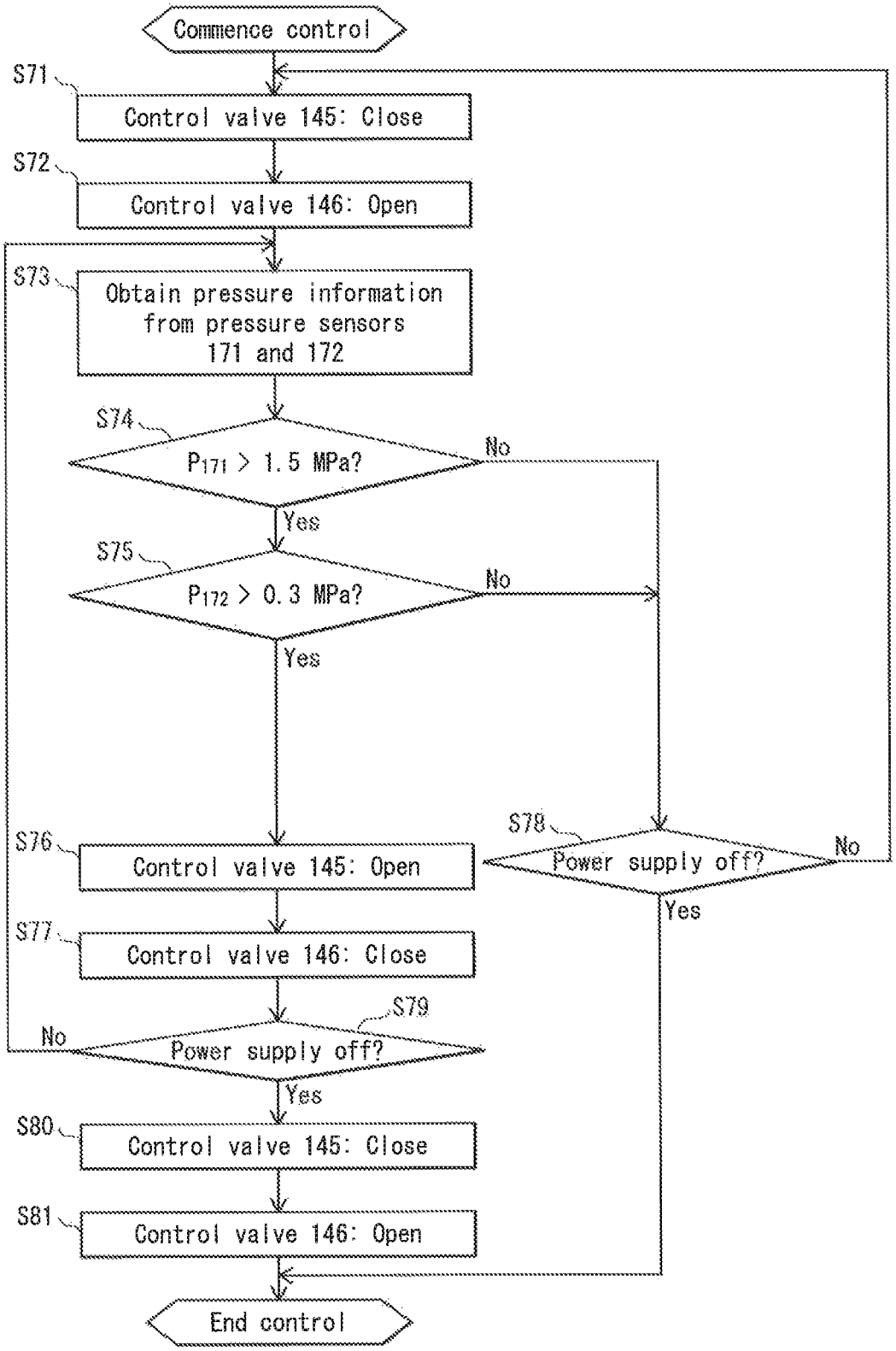
FIG. 9 is a flow chart showing control performed by a control device 75 in the air conditioning system 7 during cooling.

As shown in FIG. 9, when operation of the air conditioning system 7 commences, the control device 75 sets the control valve 145 to "Closed" (Step S71) and the control valve 146 to "Open" (Step S72). As a consequence of the above, when the air conditioning system 7 commences operation, water does not flow into the cooling tank 141. The control device 75 obtains the pressure information from the pressure sensors 171 and 172 (Step S73), and judges whether conditions shown in MATH 10 and 11 are satisfied (Steps S74 and S75).

$$P_{171}>1.5\ \text{MPa} \quad \text{[MATH 10]}$$

$$P_{172}>0.3\ \text{MPa} \quad \text{[MATH 11]}$$

The conditions in MATH 10 and 11 are for a situation where outdoor temperature is 35° C., indoor temperature is 27° C., and water supplied into the cooling tank 141 is at a constant temperature.

The control device 75, when judging that both of the conditions in MATH 10 and 11 are satisfied, sets the control valve 145 to "Open" (Step S76) and sets the control valve 146 to "Closed" (Step S77). As a consequence of the above, water flows into the cooling tank 141, and the additional heat exchanger 13 is cooled by the water. The control device 75 checks that the power supply is not turned off (Step S79: No), and subsequently repeats performance of judgments in Steps S73-S77.

The control device 75, when judging that at least one of the conditions in MATH 10 and 11 is not satisfied (Step S74 and/or S75: No), checks that the power supply is not turned off (Step S78: No), and subsequently repeats the above control from Step S71.

If the power supply is turned off (Step S79: Yes), the control device 75 sets the control valve 145 to "Closed" (Step S80) and the control valve 146 to "Open" (Step S81), and thus performance of the control is complete. In the same way, if judged that the power supply is turned off in Step S78 (Step S78: Yes), performance of the control is complete.

In the air conditioning system 7 relating to the fifth embodiment, by performing cooling of the additional heat exchanger 13 through performance of the control described above, temperature difference between intake air and discharge air of the indoor unit 11 can be increased compared to the air conditioning system relating the conventional art shown in FIG. 10. For example, in a situation where cooling potential is 21 kW, heat load is 15.4 kW, outdoor temperature is 35° C., a setting for indoor temperature is 27° C., and dimensions of an indoor space are 9900 mm×2700 mm×3000 mm, hourly electricity consumption can be reduced from 8593 Wh to 5100 Wh, providing a reduction in electricity consumption of approximately 40% to 50%.

When cooling of the additional heat exchanger 13 using water is not performed, pressure of the refrigerant at the output point from the additional heat exchanger 13 (high pressure value, discharge pipe pressure) is 2.0 MPa and pressure of the refrigerant at the input point into the compressor 121 (low pressure value; intake pipe pressure) is 0.4 MPa.

In contrast to the above, when cooling of the additional heat exchanger 13 using water is performed as described above, the high pressure value is reduced to 1.5 MPa, and temperature of discharge air from the indoor unit is also reduced (minimum discharge air temperature reduced from 7.8° C. to 4.0° C.), thus increasing the temperature difference between intake air and discharge air. The temperature difference between intake air and discharge air can be increased by approximately 4 deg. to 5 deg.

In the fifth embodiment, electricity consumption can be reduced through achieving operating conditions 25% lower than rated values. The above means for example, an upper limit for the high pressure value (pressure of the refrigerant at the output point from the additional heat exchanger 13) is reduced by 25% to 1.5 MPa compared to a rated value of 2.0 MPa, and an upper limit for the low pressure value (pressure of the refrigerant at the input point to the compressor 121) is reduced by 25% to 0.3 MPa, compared to a rated value of 0.4 MPa. The upper limits of the high pressure value and the low pressure value should be varied, depending on setup environment (outdoor load), indoor load, and ability of equipment used in configuration of the system.

For example, when considering the indoor load and the outdoor load, the upper limits should be varied as described below. Values below are for when the refrigerant is R22.

(i) When Outdoor Load and Indoor Load are Both High

In the above situation, the upper limit for the high pressure value is set as higher than 1.5 MPa, and lower than 2.0 MPa. The upper limit for the low pressure value is set as higher than 0.3 MPa, and lower than 0.4 MPa. A ratio of the set upper limit values against the rated values (high pressure value 2.0 MPa, low pressure value 0.4 MPa), gives the amount of reduction in electricity consumption.

(ii) When Outdoor Load and Indoor Load are Both Low

In contrast to the situation described in section (i), in the above situation the upper limit for the high pressure value is set as lower than 1.5 MPa, and the upper limit for the low pressure value is set as lower than 0.3 MPa.

(iii) When Outdoor Load is High and Indoor Load is Low

In the above situation, the upper limit for the high pressure value is set as lower than 1.5 MPa, and the upper limit for the low pressure value is set as higher than 0.3 MPa and lower than 0.4 MPa.

(iv) When Outdoor Load is Low and Indoor Load is High

In contrast to the situation described in section (iii), in the above situation the upper limit for the high pressure value is set as higher than 1.5 MPa and lower than 2.0 MPa, and the upper limit for the low pressure value is set as lower than 0.3 MPa.

Through setting values for the upper limits as described above, electricity consumption can be reduced.

[Supplementary Explanation]

In the embodiments and the modified examples, air conditioning systems 1-4, and 7 are given as examples of the heat exchanging system. However, the present invention is not limited by the above, and may alternatively be applied to a refrigeration system or a freezing system for example, in which case the same effects as described above are achieved.

The embodiments do not specify a source for the water supplied into cooling devices 14, 24, 34, 44 and 74, but for example tap water or ground water may be used. Ground water is not easily affected by outdoor temperature and is maintained in a certain temperature range, therefore ground water is particularly appropriate as the source for the water. If any of the air conditioning systems 1-4 and 7 described in the embodiments and modified examples is installed in a factory, waste water or waste steam discharged from industrial processes may be used in the air conditioning system. In particular, waste steam may be used to aid defrosting during heating, so long as temperature of the steam is at least slightly higher than outdoor temperature. The above also improves overall energy efficiency.

In the embodiments and the modified examples, water is used by the cooling devices 14, 24, 34, 44 and 74 to perform cooling. Alternatively, any another liquid with a high heat exchange efficiency may be used, such as oil. If oil or the like is used, collection of the oil after discharge is necessary.

In the air conditioning systems 1-4, and 7 relating to the embodiments, the additional heat exchangers 13, 33*a*-33*g* and 43*a*-43*g* are cooled using the liquid, but alternatively a configuration where the outdoor units 12, 32*a*-32*g* and 72 are directly cooled using the liquid may be adopted. In the Above configuration, the outdoor units 12, 32*a*-32*g*, and 72 may for example by stored within a cooling tank, through which a liquid used for cooling flows.

The air conditioning system 7 relating to the fifth embodiment has a configuration where pressure of the refrigerant is measured, and control of the liquid used for cooling is performed based on the pressure information indicating the measured pressures. The above configuration may also be applied in any of the second, third and fourth embodiments.

When heat exchange is performed with a liquid that is at a higher temperature than outdoor temperature, efficiency can be improved and electricity consumption can be reduced during heating.

Control during heating, when circulation direction of the refrigerant is reversed compared to during cooling, is described in the first embodiment. Heating may be achieved in any of the other embodiments in the same way, by reversing circulation direction of the refrigerant. If heating is performed in any of the other embodiments, electricity consumption can be reduced in the same way as described above.

INDUSTRIAL APPLICABILITY

The present invention can be used to realize a heat exchanging system that reduces environmental burden and achieves a high heat exchange efficiency. The present invention is simple to maintain and can be cheaply and easily applied to existing air-cooling type air conditioning systems (heat exchanging systems) to provide improved heat exchange efficiency.

REFERENCE SIGNS LIST

1, 2, 3, 4, 7 air conditioning system
11, 31*a*-31*g* indoor unit
12, 32*a*-32*g*, 72 outdoor unit
13, 33*a*-33*g*, 43*a*-43*g* additional heat exchanger
14, 24, 34, 44, 74 cooling device
15, 35, 75 control device
54 cooling coil
64 outer cooling pipe
121 compressor
122 condenser
123, 124 flow pathway switching valve
141, 241, 341, 441 cooling tank
142, 242, 342 water injection pathway
143, 243, 343 water outlet
144, 344 water discharge pathway
145, 146, 245, 345, 346 control valve
161-165, 361*a*-361*g*, 362*a*-362*g*, 363*a*-363*g*, 364, 365 temperature sensor
171, 172 pressure sensor
441*a*-441*g* cooling chamber
$L_1$-$L_7$, $L_{71}$, $L_{77}$ refrigerant piping

The invention claimed is:

1. A heat exchanging system, comprising:

a compressor;

a first heat exchanger that is a condenser during cooling;

a second heat exchanger that is an evaporator during cooling;

a temperature adjustment device configured to perform temperature adjustment of a heat carrier using a liquid, wherein the compressor, the first heat exchanger and the second heat exchanger are provided in a circulation pathway of the heat carrier, in respective order during cooling, and the temperature adjustment device is provided on (i) the first heat exchanger, or (ii) a section of the circulation pathway that during cooling is downstream of the first heat exchanger and upstream of the second heat exchanger;

a third heat exchanger, provided in the circulation pathway at a point that during cooling is downstream of the first heat exchanger and upstream of the second heat exchanger, wherein the temperature adjustment device is provided with a tank for storing a cooling liquid, and the third heat exchanger is contained within the tank;

a first temperature sensor configured to measure a temperature of the heat carrier at an output side, during cooling, of the third heat exchanger;

a second temperature sensor configured to measure a temperature in the tank;

a third temperature sensor configured to measure a peripheral temperature of the first heat exchanger;

a fourth temperature sensor configured to measure a temperature of the liquid supplied into the tank of the temperature adjustment device; and a control device configured to control a temperature adjustment condition of the temperature adjustment device, based on temperature information indicating the respective temperatures measured by the first, second, third and fourth temperature sensors.

2. The heat exchanging system in claim 1, wherein the tank of the temperature adjustment device is connected to an injection pathway for supplying the liquid thereto, and a discharge pathway for discharging the liquid therefrom, the injection pathway and the discharge pathway are each provided with a control valve for controlling flow volume of the liquid therethrough, and the control device controls the temperature adjustment condition of the temperature adjustment device, based on the temperature information of the first, second, third and fourth temperature sensors, through open/close control of each of the two control valves.

3. The heat exchanging system in claim 2, wherein the respective temperatures measured by the first, second, third and fourth temperature sensors are $T_1$, $T_2$, $T_3$ and $T_4$, and when judging that conditions (i) $T_1>T_4$, (ii) $T_3>T_4$, and (iii) $T_4 \leq T_2 < T_3$ are all satisfied, the control device opens the control valve provided in the injection pathway and closes the control valve provided in the discharge pathway.

4. The heat exchanging system in claim 1, wherein the tank of the temperature adjustment device is connected to an injection pathway for supplying the liquid thereto, and a discharge pathway for discharging the liquid therefrom, at least one spray outlet, that sprays the liquid against the third heat exchanger, is provided on a section of the injection pathway extending into the tank, the injection pathway is provided with a control valve for controlling flow volume of the liquid therethrough, and the control device controls the temperature adjustment condition of the temperature adjustment device through open/close control of the control valve.

5. The heat exchanging system in claim 4, wherein the respective temperatures measured by the first, second, third and fourth temperature sensors are $T_1$, $T_2$, $T_3$ and $T_4$, and when judging that conditions (i) $T_1>T_4$, (ii) $T_3>T_4$, and (iii) $T_4 \leq T_2<T_3$ are all satisfied, the control device opens the control valve provided in the injection pathway.

6. A heat exchanging system, comprising:

a compressor;

a first heat exchanger that is a condenser during cooling;

a second heat exchanger that is an evaporator during cooling;

a temperature adjustment device configured to perform temperature adjustment of a heat carrier using a liquid, wherein the compressor, the first heat exchanger and the second heat exchanger are provided in a circulation pathway of the heat carrier, in respective order during cooling, and the temperature adjustment device is provided on (i) the first heat exchanger, or (ii) a section of the circulation pathway that during cooling is downstream of the first heat exchanger and upstream of the second heat exchanger;

a third heat exchanger, provided in the circulation pathway at a point that during cooling is downstream of the first heat exchanger and upstream of the second heat exchanger, wherein the temperature adjustment device is provided with a tank for receiving a cooling liquid, and the third heat exchanger is contained within the tank to contact the cooling liquid;

a first temperature sensor configured to measure a temperature of the heat carrier at an output side, during cooling, of the third heat exchanger;

a second temperature sensor configured to measure a temperature in the tank;

a third temperature sensor configured to measure a peripheral temperature of the first heat exchanger;

a fourth temperature sensor configured to measure a temperature of the liquid supplied into the tank of the temperature adjustment device; and a control device configured to control a temperature adjustment condition of the temperature adjustment device, based on temperature information indicating the respective temperatures measured by the first, second, third and fourth temperature sensors.

7. The heat exchanging system in claim 6, wherein the tank of the temperature adjustment device is connected to an injection pathway for supplying the liquid thereto, and a discharge pathway for discharging the liquid therefrom, the injection pathway and the discharge pathway are each provided with a control valve for controlling flow volume of the liquid therethrough, and the control device controls the temperature adjustment condition of the temperature adjustment device, based on the temperature information of the first, second, third and fourth temperature sensors, through open/close control of each of the two control valves.

8. The heat exchanging system in claim 6, wherein the tank of the temperature adjustment device is connected to an injection pathway for supplying the cooling liquid thereto, and a discharge pathway for discharging the liquid therefrom, the cooling liquid is applied to the third heat exchanger, and the injection pathway is provided with a control valve for controlling flow volume of the liquid therethrough, and the control device controls the temperature adjustment condition of the temperature adjustment device through open/close control of the control valve.

9. The heat exchanging system in claim 8, wherein the respective temperatures measured by the first, second, third and fourth temperature sensors are $T_1$, $T_2$, $T_3$ and $T_4$, and when judging that conditions (i) $T_1>T_4$, (ii) $T_3>T_4$, and (iii) $T_4 \leq T_2<T_3$ are all satisfied, the control device opens the control valve provided in the injection pathway.

* * * * *